US008635018B2

(12) United States Patent
Chia et al.

(10) Patent No.: US 8,635,018 B2
(45) Date of Patent: Jan. 21, 2014

(54) MANAGING A DRIVER PROFILE

(75) Inventors: Gee N. Chia, Morrisville, NC (US); Christopher M. Laffoon, Durham, NC (US); Viswanath Srikanth, Chapel Hill, NC (US)

(73) Assignee: International Business Machines Corporation, Amonk, NY (US)

( * ) Notice: Subject to any disclaimer, the term of this patent is extended or adjusted under 35 U.S.C. 154(b) by 0 days.

(21) Appl. No.: 13/365,403

(22) Filed: Feb. 3, 2012

(65) Prior Publication Data

US 2013/0204455 A1 Aug. 8, 2013

(51) Int. Cl.
*G08B 5/22* (2006.01)

(52) U.S. Cl.
USPC ..... 701/424; 701/9; 701/25; 701/26; 701/33.2; 701/45; 701/49; 701/425

(58) Field of Classification Search
CPC ..... B60K 28/00; B60K 28/02; B60K 28/04; B60K 2350/90; B60K 2350/901; B60K 31/00; B60K 31/16; B60K 31/18
USPC ..... 340/4.6, 5.72, 425.5, 428, 426.13, 340/426.16, 438, 441, 901–905, 932, 932.2, 340/933, 935, 938, 988–994, 995.17; 359/841–844; 701/9, 25–26, 33.2, 45, 701/49, 424–425
See application file for complete search history.

(56) References Cited

U.S. PATENT DOCUMENTS 4,853,720 A 8/1989 Onari et al.
6,629,029 B1 * 9/2003 Giles ..... 701/31.4
7,302,344 B2 11/2007 Olney et al.
8,260,491 B2 * 9/2012 Brighenti et al. ..... 701/34.1
8,280,560 B2 * 10/2012 Huang et al. ..... 701/1
2004/0209594 A1 * 10/2004 Naboulsi ..... 455/404.1
2007/0257781 A1 11/2007 Denson
2008/0042815 A1 * 2/2008 Breed et al. ..... 340/435
2008/0069403 A1 * 3/2008 Breed ..... 382/104
2008/0165018 A1 * 7/2008 Breed ..... 340/573.1

(Continued)

FOREIGN PATENT DOCUMENTS

CN 201665188 U 12/2010

OTHER PUBLICATIONS

"Route Guidance System with Duplicate User Interfaces", IP.com, IP.com No. IPCOM000007153D, published on the world wide web at http://ip.com/IPCOM/000007153, Published Feb. 1, 1994.

(Continued)

*Primary Examiner* — Mary Cheung
*Assistant Examiner* — Atul Trivedi
(74) *Attorney, Agent, or Firm* — Paul S. Drake

(57) ABSTRACT

A method, system or computer usable program product for porting driver preferences between vehicles including initiating a first communication session between a computer in the first vehicle and an external device, receiving a driver profile from the first vehicle in the external device, wherein the driver profile was used to configure warnings and other driver settings in the first vehicle, initiating a second communication session between the external device and a computer in a second vehicle, transferring the driver profile from the external device to a second memory in the second vehicle, and using the driver profile to configure warning and other driver settings in the second vehicle.

17 Claims, 6 Drawing Sheets

(56) References Cited

U.S. PATENT DOCUMENTS

| | | | | |
|---|---|---|---|---|
| 2008/0258890 | A1* | 10/2008 | Follmer et al. | 340/439 |
| 2009/0234552 | A1* | 9/2009 | Takeda et al. | 701/96 |
| 2009/0240391 | A1* | 9/2009 | Duddle et al. | 701/33 |
| 2010/0023197 | A1* | 1/2010 | Huang et al. | 701/29 |
| 2010/0023223 | A1* | 1/2010 | Huang et al. | 701/44 |
| 2010/0052945 | A1* | 3/2010 | Breed | 340/903 |
| 2010/0207754 | A1* | 8/2010 | Shostak et al. | 340/450 |
| 2010/0209889 | A1 | 8/2010 | Huang et al. | |
| 2010/0256852 | A1* | 10/2010 | Mudalige | 701/24 |
| 2011/0128118 | A1* | 6/2011 | Gilleland et al. | 340/5.2 |
| 2011/0210867 | A1* | 9/2011 | Benedikt | 340/905 |

OTHER PUBLICATIONS

"Method for Enhancement of Vehicle Collision Avoidance Systems Based on Driver Characteristics", IP.com, IP.com No. IPCOM000004739D, published on the world wide web at http://ip.com/IPCOM/000004739, Published Apr. 25, 2001.

Mizushima et al, "Direct Yaw-moment Control Adapted to Driver Behavior Recognition", SICE-ICASE International Joint Conference 2006, pp. 534-539, Published Oct. 18, 2006.

McCall et al, "Driver Behavior and Situation Aware Brake Assistance for Intelligent Vehicles", Proceedings of the IEEE, pp. 374-387, vol. 95, No. 2, Feb. 2007.

* cited by examiner

MANAGING A DRIVER PROFILE

BACKGROUND

1. Technical Field

The present invention relates generally to managing a driver profile, and in particular, to a computer implemented method for developing, managing and porting a driver profile between multiple vehicles.

2. Description of Related Art

Today vehicles are becoming more intelligent with the advent of onboard computers. The computers can be used to improve performance, economy, safety or comfort. For example, computers and sensors may be used to manage the operation of the engine to increase performance or improve economy, to automatically parallel park a car, or even to apply brakes before colliding with an object in the path of the vehicle. More recently, computers and sensors of a vehicle may be used to assess and classify a driver's skills which may be used for warning purposes.

SUMMARY

The illustrative embodiments provide a method, system, and computer usable program product for porting driver preferences between vehicles including initiating a first communication session between a computer in the first vehicle and an external device, receiving a driver profile from the first vehicle in the external device, wherein the driver profile was used to configure warnings and other driver settings in the first vehicle, initiating a second communication session between the external device and a computer in a second vehicle, transferring the driver profile from the external device to a second memory in the second vehicle, and using the driver profile to configure warning and other driver settings in the second vehicle.

BRIEF DESCRIPTION OF THE SEVERAL VIEWS OF THE DRAWINGS

The novel features believed characteristic of the invention are set forth in the appended claims. The invention itself, further objectives and advantages thereof, as well as a preferred mode of use, will best be understood by reference to the following detailed description of illustrative embodiments when read in conjunction with the accompanying drawings, wherein:

DETAILED DESCRIPTION

Managing and porting a driver profile between multiple vehicles will be explained with reference to the various embodiments below.

Figure 1:
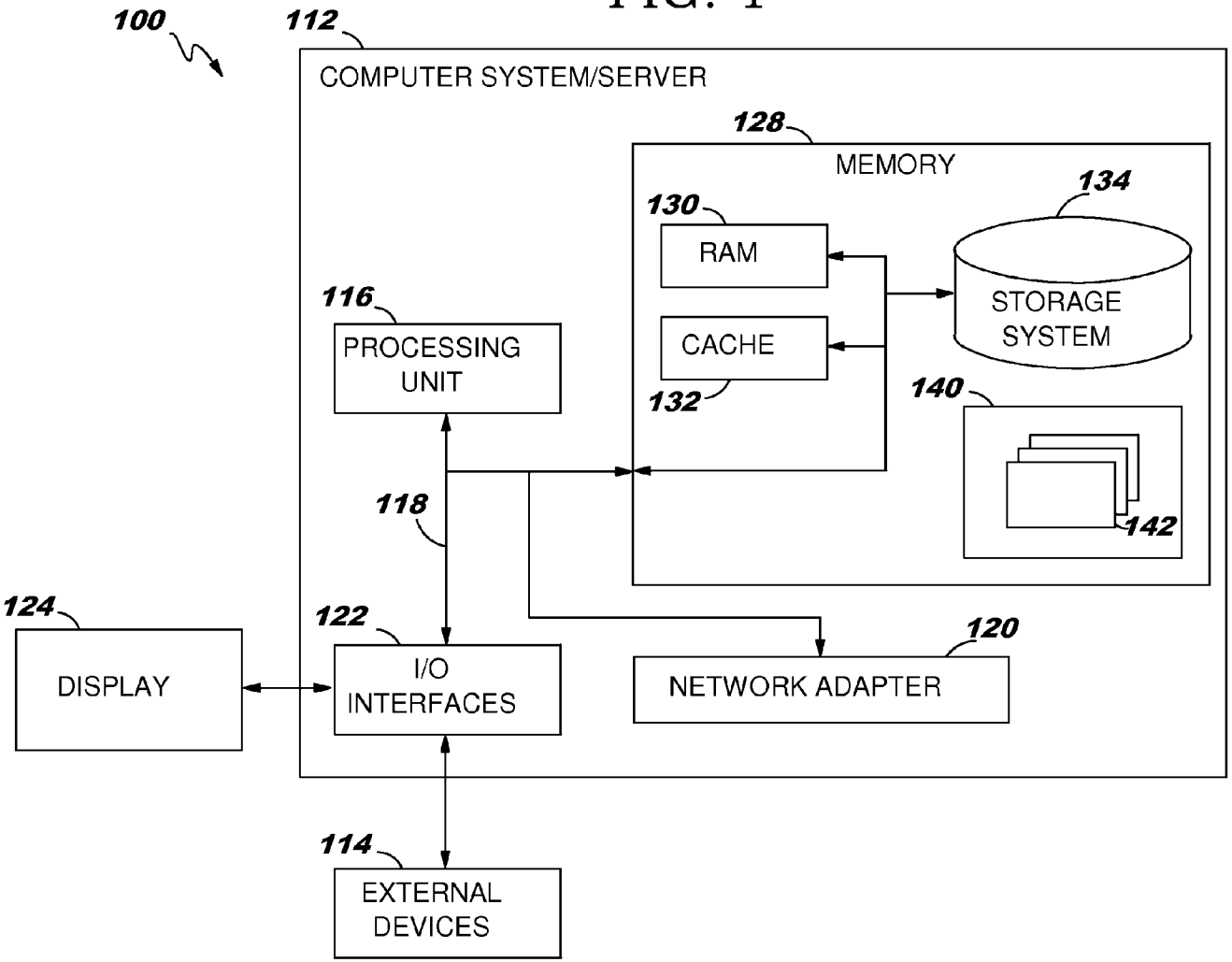
FIG. 1 is a block diagram of a data processing system in which various embodiments may be implemented.

FIG. 1 is a block diagram of a data processing system in which various embodiments may be implemented. Data processing system 100 is only one example of a suitable data processing system and is not intended to suggest any limitation as to the scope of use or functionality of embodiments of the invention described herein. Regardless, data processing system 100 is capable of being implemented and/or performing any of the functionality set forth herein.

In data processing system 100 there is a computer system/server 112, which is operational with numerous other general purpose or special purpose computing system environments or configurations. Examples of well-known computing systems, environments, and/or configurations that may be suitable for use with computer system/server 112 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 112 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 112 may be practiced in distributed computing environments where tasks are performed by remote processing devices that are linked through a communications network. In a distributed computing environment, program modules may be located in both local and remote computer system storage media including memory storage devices.

As shown in FIG. 1, computer system/server 112 in data processing system 100 is shown in the form of a general-purpose computing device. The components of computer system/server 112 may include, but are not limited to, one or more processors or processing units 116, a system memory 128, and a bus 118 that couples various system components including system memory 128 to processor 116.

Bus 118 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 112 typically includes a variety of computer system readable media. Such media may be any available media that is accessible by computer system/server 112, and it includes both volatile and non-volatile media, removable and non-removable media.

System memory 128 can include computer system readable media in the form of volatile memory, such as random access memory (RAM) 130 and/or cache memory 132. Computer system/server 112 may further include other removable/non-removable, volatile/non-volatile computer system storage media. By way of example only, storage system 134 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 118 by one or more data media interfaces. Memory 128 may include at least one program product having a set (e.g., at least one) of program modules that are configured to carry out the functions of embodiments of the invention. Memory 128 may also include data that will be processed by a program product.

Program/utility 140, having a set (at least one) of program modules 142, may be stored in memory 128 by way of example, and not limitation, as well as an operating system, one or more application programs, other program modules, and program data. Each of the operating system, one or more application programs, other program modules, and program data or some combination thereof, may include an implementation of a networking environment. Program modules 142 generally carry out the functions and/or methodologies of embodiments of the invention. For example, a driver profile may be developed, managed and ported between multiple vehicles.

Computer system/server 112 may also communicate with one or more external devices 114 such as a keyboard, a pointing device, a display 124, etc.; one or more devices that enable a user to interact with computer system/server 112; and/or any devices (e.g., network card, modem, etc.) that enable computer system/server 112 to communicate with one or more other computing devices. Such communication can occur via I/O interfaces 122. Still yet, computer system/server 112 can communicate with one or more networks such as a local area network (LAN), a general wide area network (WAN), and/or a public network (e.g., the Internet) via network adapter 120. As depicted, network adapter 120 communicates with the other components of computer system/server 112 via bus 118. It should be understood that although not shown, other hardware and/or software components could be used in conjunction with computer system/server 112. Examples, include, but are not limited to: microcode, device drivers, redundant processing units, external disk drive arrays, RAID systems, tape drives, and data archival storage systems, etc.

Figure 2:
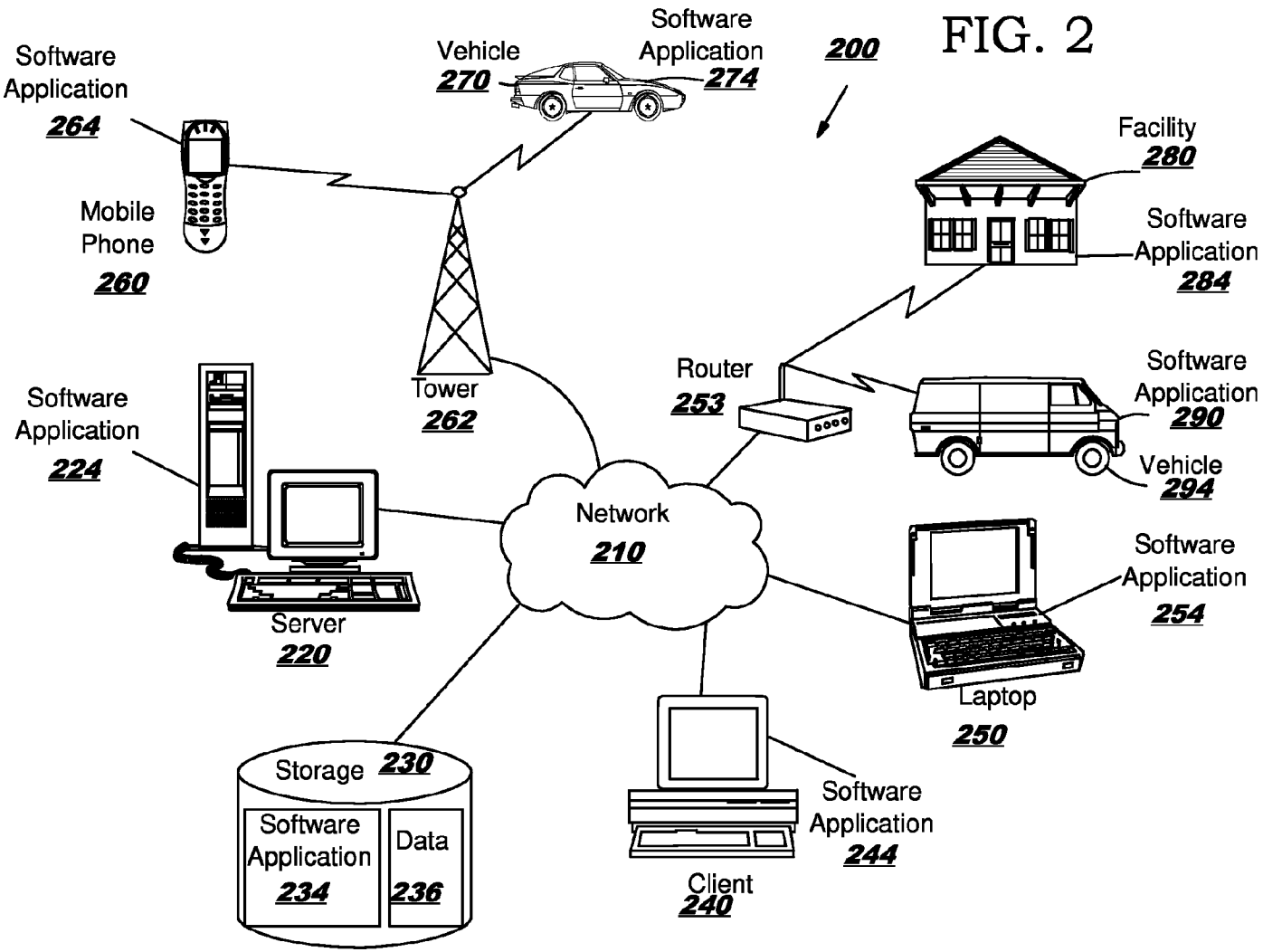
FIG. 2 is a block diagram of a network of data processing systems in which various embodiments may be implemented.

FIG. 2 is a block diagram of a network of data processing systems in which various embodiments may be implemented. Data processing environment 200 is a network of data processing systems such as described above with reference to FIG. 1. Software applications may execute on any computer or other type of data processing system in data processing environment 200. Data processing environment 200 includes network 210. Network 210 is the medium used to provide communications links between various devices and computers connected together within data processing environment 200. Network 210 may include connections such as wire, wireless communication links, or fiber optic cables.

Server 220 and client 240 are coupled to network 210 along with storage unit 230. In addition, laptop 250, facility 280 (such as a home or business) and vehicle 290 are coupled to network 210 including wirelessly such as through a network router 253. A mobile phone 260 and vehicle 270 may be coupled to network 210 through a mobile phone tower 262. Data processing systems, such as server 220, client 240, laptop 250, mobile phone 260, vehicle 270, facility 280 and vehicle 290 contain data and have software applications including software tools executing thereon. Other types of data processing systems such as personal digital assistants (PDAs), smartphones, tablets and netbooks may be coupled to network 210.

Server 220 may include software application 224 such as for developing, managing and porting a driver profile between multiple vehicles or other software applications in accordance with embodiments described herein. Storage 230 may contain software application 234 and a content source such as data 236 for a driver profile including driver preferences. Other software and content may be stored on storage 230 for sharing among various computer or other data processing devices. Client 240 may include software application 244. Laptop 250, mobile phone 260 and vehicle 270 may also include software applications 254, 264 and 274 respectively. Facility 280 and vehicle 290 may include software applications 284 and 294. Other types of data processing systems coupled to network 210 may also include software applications. Software applications could include a web browser, email, or other software application that can develop, manage and port a driver profile between multiple vehicles.

Server 220, storage unit 230, client 240, laptop 250, mobile phone 260, vehicle 270, facility 280 and vehicle 290 and other data processing devices may couple to network 210 using wired connections, wireless communication protocols, or other suitable data connectivity. Client 240 may be, for example, a personal computer or a network computer. Vehicles 270, 290 and mobile phone 260 or other devices may alternatively communicate through Bluetooth, Near field communication (NFC) or other short range wireless technologies rather than network 210.

In the depicted example, server 220 may provide data, such as boot files, operating system images, and applications to client 240 and laptop 250. Client 240 and laptop 250 may be clients to server 220 in this example. Client 240, laptop 250, mobile phone 260, vehicle 270, facility 280 and vehicle 290 or some combination thereof, may include their own data, boot files, operating system images, and applications. Data processing environment 200 may include additional servers, clients, and other devices that are not shown.

In the depicted example, data processing environment 200 may be the Internet. Network 210 may represent a collection of networks and gateways that use the Transmission Control Protocol/Internet Protocol (TCP/IP) and other protocols to communicate with one another. At the heart of the Internet is a backbone of data communication links between major nodes or host computers, including thousands of commercial, governmental, educational, and other computer systems that route data and messages. Of course, data processing environment 100 also may be implemented as a number of different types of networks, such as for example, an intranet, a local area network (LAN), or a wide area network (WAN). FIG. 2 is intended as an example, and not as an architectural limitation for the different illustrative embodiments.

Among other uses, data processing environment 200 may be used for implementing a client server environment in which the embodiments may be implemented. A client server environment enables software applications and data to be distributed across a network such that an application functions by using the interactivity between a client data processing system and a server data processing system. Data processing environment 100 may also employ a service oriented architecture where interoperable software components distributed across a network may be packaged together as coherent business applications.

Figure 3:
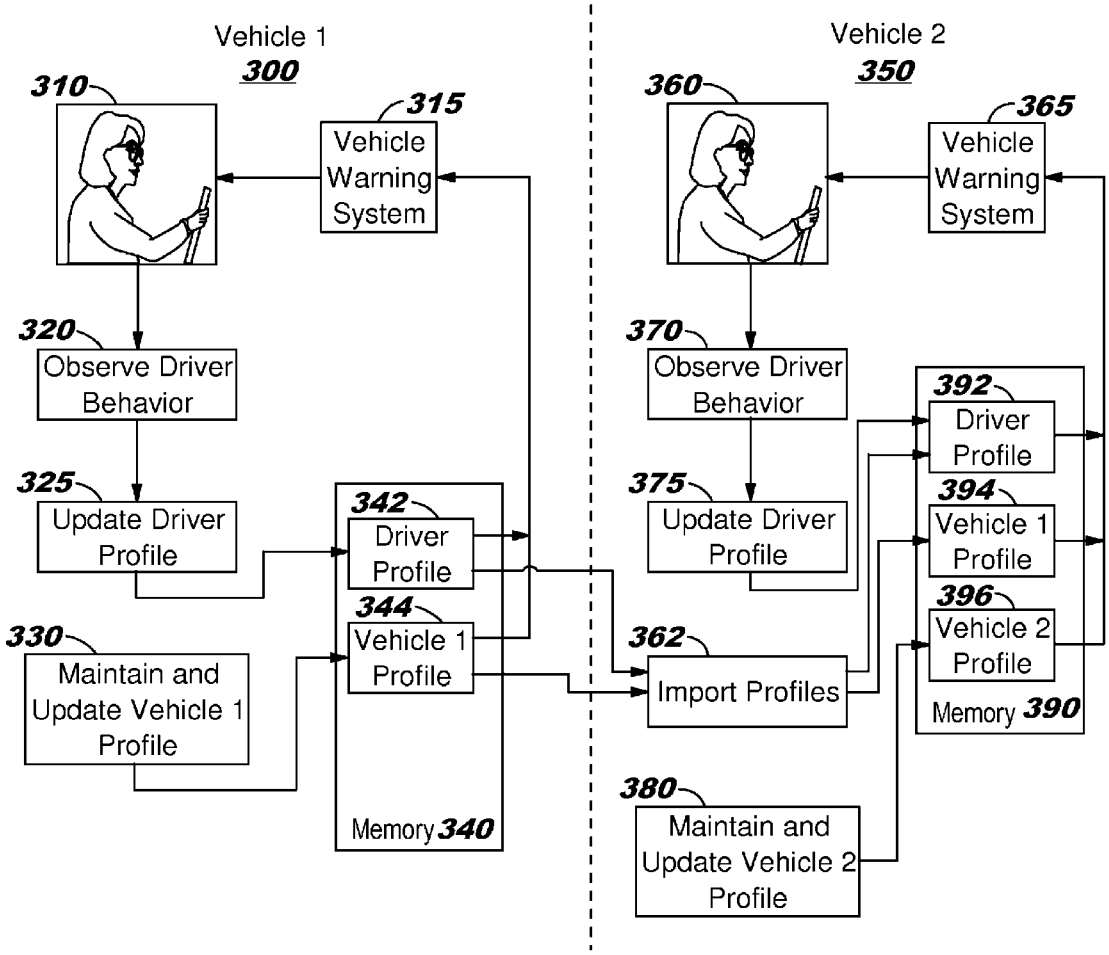
FIG. 3 is a block diagram of a driver driving two different vehicles in sequence in accordance with a first embodiment.

FIG. 3 is a block diagram of a driver driving two different vehicles in sequence in accordance with a first embodiment. A driver is shown driving Vehicle 1 300 in the diagram shown in block 310. Vehicle 1 may be a car, an SUV, a minivan or van, a small pickup truck, a large commercial truck, or one of a large variety of vehicles. Vehicle 1 includes a warning system 315 that can perform various actions to alert the driver to hazards or dangerous conditions including sounding an alert, applying brakes to one or more tires, or other possible actions. Conditions that can give rise to an action include braking distance to a vehicle in front, speed in curves, proximity to a neighboring vehicle, etc. The conditions which give rise to these warnings may be modified based on the driver's profile 342 or on the vehicle 1's profile 344, which are stored in memory 340. For example, a driver may have a slower reaction time than normal, a more aggressive driving style, etc. In addition, a vehicle may be heavier with a longer braking distance or have older tires with less traction in rain. These observations saved in driver profile 342 and vehicle profile 344 may be used to modify the conditions which give rise to an action by the warning system. For example, if the driver aggressively drives a smaller vehicle with short braking distance and then transfers to a larger vehicle with a longer braking distance, the warning system may more quickly generate a braking warning based on the aggressiveness of the driver and the fact the larger vehicle has a longer braking distance than the vehicle previously driven by the driver.

One of the first actions of warning system 315 is to identify the driver. For example, multiple drivers may utilize vehicle 1. As a result, in a preferred embodiment, each driver should have a different profile. This identification may be performed by a password or pin code that the driver may enter onto a dashboard interactive screen, by the use of biometrics, voice recognition or by the driver carrying a key fob with an RFID or other identifying device. Alternative embodiments may use other methods of identifying the driver.

As the driver drives vehicle 1, his or her driving behavior is observed by a variety of sensors or observations of actions in block 320. These observations are compared to a standard set of driver attributes. For example, if the car consistently decelerates significantly before coming to a stop, the driver is observed as having poor reaction time, poor depth perception, or other observations. As a result of these observations the driver's profile 342 may be modified in block 325.

The driver profile may also include certain driver preferences. For example, seat position, mirror position, climate control preferences, radio settings, etc. If multiple persons are driving the same vehicle, then once the driver is identified, the preferences for that driver may be implemented.

Also, the vehicle's condition may be monitored in block 330. For example, the braking may take longer than expected for a given amount of foot pressure on the brake pedal due to warn brake pads. The vehicle may not corner as well due to worn tires or due to low tire pressure. These conditions may be monitored in block 330 to maintain and update the vehicle 1 profile 344. These observations may be used to modify the conditions which give rise to an action by the warning system.

Both the driver profile 342 and the vehicle 1 profile 344 are stored in memory, which may be the memory of vehicle 1 such as a type of flash memory or other robust memory suitable for vehicular applications. The memory may also be uploaded to a key fob or other mobile external device such as a cell phone which travels with the driver. The profiles may be stored in a variety of formats in memory such as an XML document or a spreadsheet type format. This type of format may be helpful in transferring the profiles from one memory to another memory. The transfer of profile from vehicle to device can be accomplished by Bluetooth, Near field communication (NFC) or other short range wireless technologies or, in the alternative, cellular connections to network 210 can be used or a physical connection.

Both profiles may be utilized by the vehicle warning system 315 to generate warnings upon certain conditions. For example, if a diver has shown to have a slow reaction time or if the vehicle takes longer to brake due to worn brake pads, then a warning to brake may be produced at a greater distance from an upcoming object that would otherwise be given for a driver with normal reaction time and a vehicle with normal braking distance. The warning system may apply brakes prior to the driver applying brakes in certain conditions such as an imminent collision.

Once the driver transfers to a different vehicle, the driver may import 362 the driver profile and vehicle 1 profile from vehicle 1 memory 340 to vehicle 2 memory 390. This may be performed by transferring the data from memory 340 to an external mobile memory such as a key fob by a Bluetooth connection, a flash drive such as through a USB connection, or other mobile device. When the driver enters vehicle 2, that information may then be transferred from the mobile device to memory 390 as driver profile 392 and vehicle 1 profile 394. The communication of profiles from vehicle 1 to vehicle 2 may also be performed directly between vehicles such as when both vehicles are in close proximity to each other. For example, if vehicle 1 and vehicle 2 are close together such as in a common garage, then the vehicles may be able to establish a Bluetooth, NFC, or other short range wireless connection to directly communicate the profiles with each other. Vehicle 2 may also have a preexisting vehicle 2 profile 396 stored in memory 390.

The transfer of the driver profile to vehicle 2 may be used to identify the driver. Optionally, this may be confirmed by warning system 365. For example, multiple drivers may utilize vehicle 2, especially if vehicle 2 is a rental vehicle. This identification confirmation may be performed by a password or pin code that the driver may enter onto a dashboard interactive screen, by the use of biometrics, voice recognition, or by the driver carrying a key fob with an RFID or other identifying device.

The driver is shown driving vehicle 2 350 shown as block 360 in the diagram. Vehicle 2 may be similar to or very different from vehicle 1. Vehicle 2 includes a warning system 365 that can perform various actions to alert the driver to hazards or dangerous conditions including sounding an alert, applying brakes to one or more tires, or other possible actions. Conditions that can give rise to an action can include the same conditions as vehicle 1 or they may be different conditions. For example, vehicle 2 may be a commercial truck with different concerns from an automobile such as making wide turns at intersections and may have air brakes that may have issues with overuse as pressure drops with multiple repeated uses in a short time period. The conditions which give rise to these warnings may be modified based on the driver's profile 392 or on the vehicle 2's profile 394. The differences from the vehicle 1 profile may also be utilized by the warning system to identify the differences from vehicle 2. For example, if the driver has transferred from a small car to a large truck, the driver may initially need a more sensitive brake warning when approaching vehicles in the path of vehicle 2.

As the driver drives vehicle 2, his or her driving behavior may be observed by a variety of sensors or observations of actions in block 370. These observations can be compared to a standard set of driver attributes. For example, if the car consistently decelerates significantly before coming to a stop, the driver may be observed as having poor reaction time, poor depth perception, or other observations. As a result of these observations the driver's profile 392 may be modified in block 395.

As mentioned above with reference to vehicle 1, the driver profile may also include certain driver preferences. For example, seat position, mirror position, climate control preferences, radio settings, etc. Once the driver is identified in vehicle 2 and the driver profile has been imported, then the preferences for that driver may be implemented in vehicle 2.

Also, the vehicle's condition may be monitored in block 380. For example, the braking may take longer than expected for a given amount of foot pressure on the brake pedal due to warn brake pads. The vehicle may not corner as well due to worn tires or due to low tire pressure. These conditions may be monitored in block 380 to maintain and update the vehicle 2 profile 396. These observations may be used to modify the conditions which give rise to an action by the warning system.

Driver profile 392, vehicle 1 profile 394 and vehicle 2 profile 396 are stored in memory, which may be the memory of vehicle 2 such as a type of flash memory or other robust memory suitable for vehicular applications. The memory may also be located in a key fob, cell phone or other mobile device which travels with the driver. The profiles may be stored in a variety of forms in memory such as an XML document or a spreadsheet type format. This type of form may be helpful in transferring the profiles from one memory to another memory.

All three profiles may be utilized by the vehicle warning system 365 to generate warnings upon certain conditions. For example, if a diver has shown to have a slow reaction time or if the vehicle takes longer to brake due to worn brake pads, then a warning to brake may be produced at a greater distance from an upcoming object that would otherwise be given for a driver with normal reaction time and a vehicle with normal braking distance. The warning system may apply brakes prior to the driver applying brakes in certain conditions such as an imminent collision.

In an alternative embodiment, a smart phone application may be utilized to communicate with each vehicle such as through a blue tooth connection. The application could communicate with each vehicle to establish the driver's identify and to download the driver's profile. The smart phone application could also determine the vehicle's identity to identify the appropriate vehicle profile for downloading, or alternatively could rely on the selection of the vehicle in the user interface. An update to the application could change the default profile that might be particularly useful in the case of a recall or if there was something about the braking behavior that indicates that the driver should bring in the car for maintenance. Some new cars have their own computers which might have the same application which could sync with the smart phone application.

Figure 4:
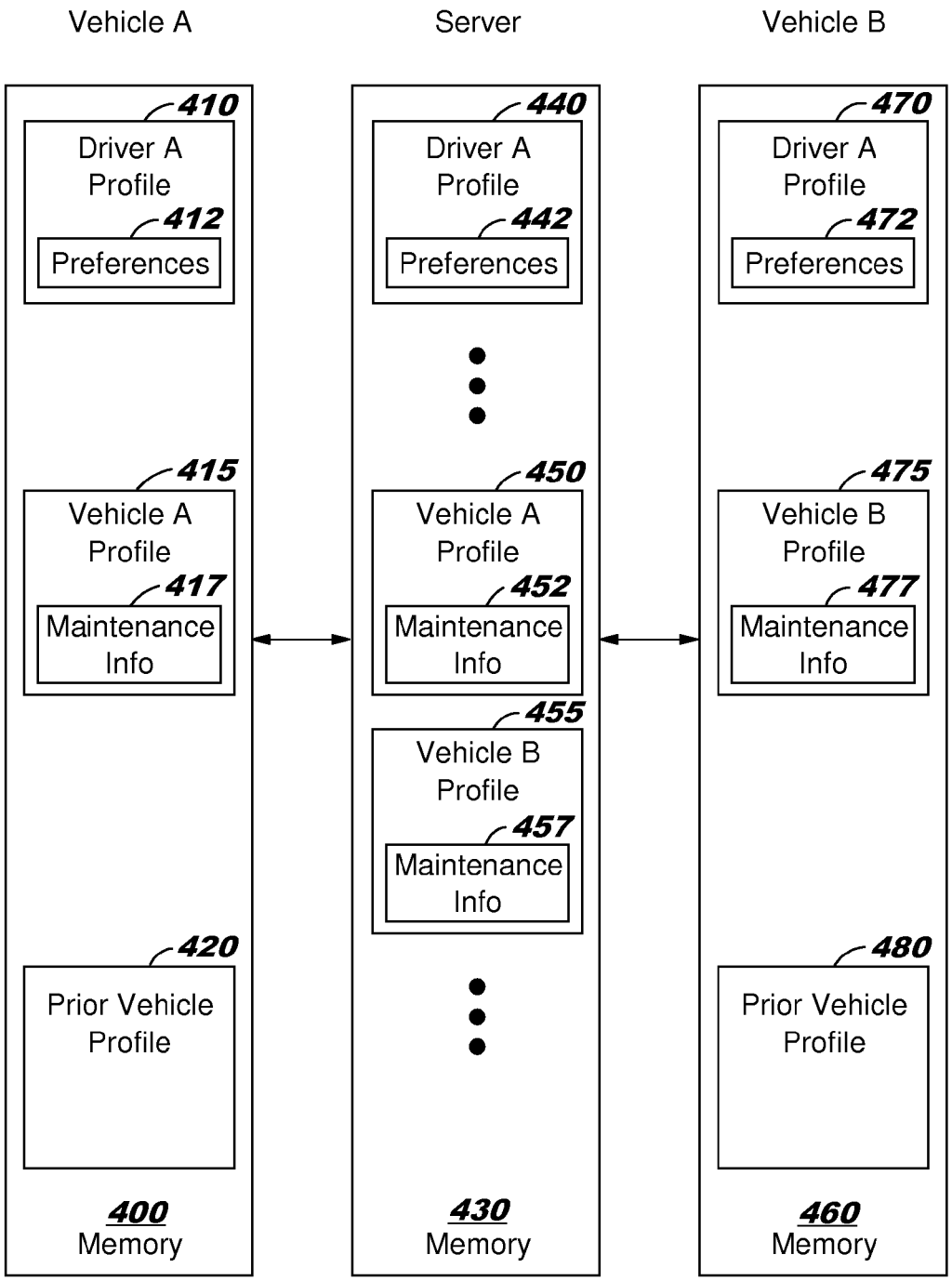
FIG. 4 is a block diagram of the memory of two vehicles and a server in accordance with a second embodiment.

FIG. 4 is a block diagram of the memory of two vehicles and a server in accordance with a second embodiment. Vehicle A has a memory 400 that is updated and utilized similar to as shown above with reference to FIG. 3 except as described below. Vehicle A memory 400 includes a driver profile A 410, a vehicle A profile 415 and a prior vehicle profile 420. Prior vehicle profile 420 would be the vehicle profile of the vehicle(s) previously driven by driver A. The driver A profile has a set of preferences 412. The vehicle A profile includes maintenance information 417.

This maintenance information may be used to modify conditions for warnings by a warning system. For example, if the brake pads of a vehicle are worn and those brake pads are replaced, then the breaks should work more effectively. As a result, less sensitive warnings are needed for objects or vehicles in the path of vehicle A. Sensors may be able to detect some of these maintenance items or the entity performing the maintenance may instruct the vehicle A systems that such maintenance was performed.

The server has an external memory 430 for storing up to date information about various drivers and vehicles. This memory may be located on a single server or it may be stored in a distributed manner on the cloud. Server memory includes an up to date version of driver A profile 440 including that driver's preferences 442. Additional driver profiles may be stored here as indicated by the " . . . " below the driver A profile. In addition, up to date vehicle A profile 450 and vehicle B profile 455 are stored including maintenance information 452 and 457. In an alternative embodiment, such maintenance information may not be stored centrally on a server. Additional vehicle profiles may be stored here as indicated by the " . . . " below the vehicle B profile.

Vehicle B has a memory 460 that is updated and utilized similar to as shown above with reference to FIG. 3 except as described below. Vehicle A memory 460 includes a driver profile A 470, a vehicle B profile 475 and a prior vehicle profile 480. Prior vehicle profile 480 would be the vehicle profile of the vehicle(s) previously driven by driver A. The driver A profile has a set of preferences 472. The vehicle B profile includes maintenance information 477.

In this second embodiment, profiles may be downloaded when a vehicle in started and then uploaded when the vehicle is turned off. Such downloads and uploads may occur through cellular phone communications, through internet hot spots, or many other types of communications. In alternative embodiments, downloads and uploads may occur periodically or when the vehicle reaches an internet hot spot.

As a driver turns on a vehicle, that driver may be identified through a variety of methods including the use of a password, pin code, biometrics, voice recognition or a key fob RFID. Once identified, the vehicle can then download that driver's profile including any recent updates and the vehicle profile of the vehicle(s) previously driven by that driver. This will allow the vehicle's warning system to work with the latest information regarding the driver and that driver's prior vehicle(s). This approach will be particularly useful where the vehicle is a rental or commercial vehicle with multiple drivers or where a driver has experience with a variety of vehicles.

Figure 5:
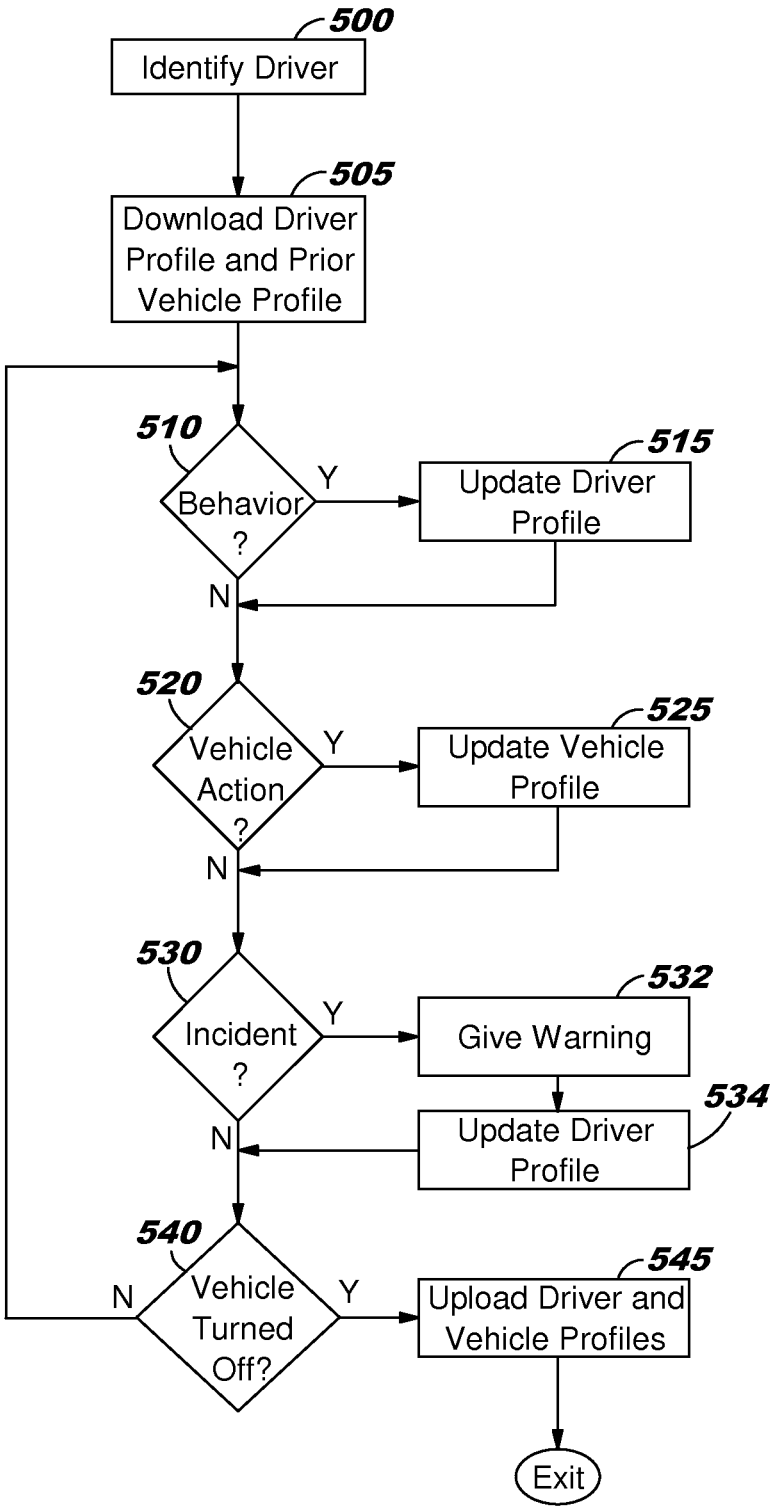
FIG. 5 is a flowchart showing the general operation of a vehicle warning system in which various embodiments may be implemented.

FIG. 5 is a flowchart showing the general operation of a vehicle warning system in which various embodiments may be implemented. In a first step 500 the driver is identified when the vehicle is started. This can be accomplished through a variety of methods including the driver entering a password or a pin code through a touchscreen or verbally, through the use of biometrics such as face or voice recognition, the use of a wireless identifier such as an RFID located in a key fob, or through the use of a flash drive device inserted into a USB port on the vehicle. Once identified, the driver profile and prior vehicle profile for that driver are downloaded. This may be through a mobile device as described above with reference with the first embodiment or through a wireless connection to a centralized memory as described above with reference to the second embodiment. Processing then proceeds to steps 510, 520, 530 and 540 repeatedly until the vehicle is turned off by the driver.

In step 510, the warning system determines whether a significant driver behavior has been observed by the system. This may be a late hard braking action, rapid acceleration, sudden swerving, or any other type of observable significant behavior. This behavior may be compared to a standard of behavior that has been assembled from the observations of many drivers. For example, if a driver tends to brake later than most drivers as observed by the driver consistently braking hard before stopping, that tendency is identified and stored as a driver behavior. Also, if the driver demonstrates good driving behavior such as rapid response to a warning demonstrating fast driver reaction time, that behavior is also identified and stored as a driver behavior. If no such behavior has been observed by the warning system, then processing continues to step 520. If such a behavior has been observed, then in step 515 the driver profile for that driver is updated accordingly and processing then proceeds to step 520.

In step 520, the warning system determines whether a significant vehicle action has been identified by the warning system. This may be a change in the braking ability of the vehicle, a loss of acceleration ability, an unexpected slippage of the tires, etc. If no such behavior has been observed by the warning system, then processing continues to step 530. If such a behavior has been observed, then in step 525 the vehicle profile for the vehicle is updated accordingly and processing then proceeds to step 530.

In step 530, the warning system determines whether an incident is occurring that prompts an action by the warning system. This may be an object or another vehicle in the path of the vehicle, another vehicle in the adjacent lane when the driver is changing lanes, the use of cruise control when the windshield wipers are on (indicating rain) and some slippage of the tires being detected, etc. If no such incident has been detected by the warning system, then processing continues to step 540. If such an incident has been observed, then in step 532 a warning is given to the driver which may include an action by the warning system to brake the vehicle or disabling the cruise control. Subsequently, the driver profile may be updated based on the type of incident and processing then proceeds to step 540.

Steps 515, 525 and 534 may interact in determining a profile change according to a given maneuver. For example, a warning may be given for the driver changing lanes when another vehicle is in the adjoining lane. The driver may react quickly and swerve back to the proper lane, but there may be undue understeer or oversteer caused by possible improper tire pressure. In such a case, the driver profile may be updated to reflect his or her difficulty with seeing an adjoining vehicle, his or her fast reaction time. In addition, the vehicle profile may be updated to reflect that tire pressure needs to be checked and that the vehicle may not respond as quickly to an emergency maneuver.

In step 540, the warning system determines whether the vehicle has been turned off by the driver. If not, then processing returns to step 510. Otherwise, in step 545 the driver and vehicle profiles may be uploaded to external memory such as to a mobile device as in the first embodiment or to a server as in the second embodiment.

Figure 6:
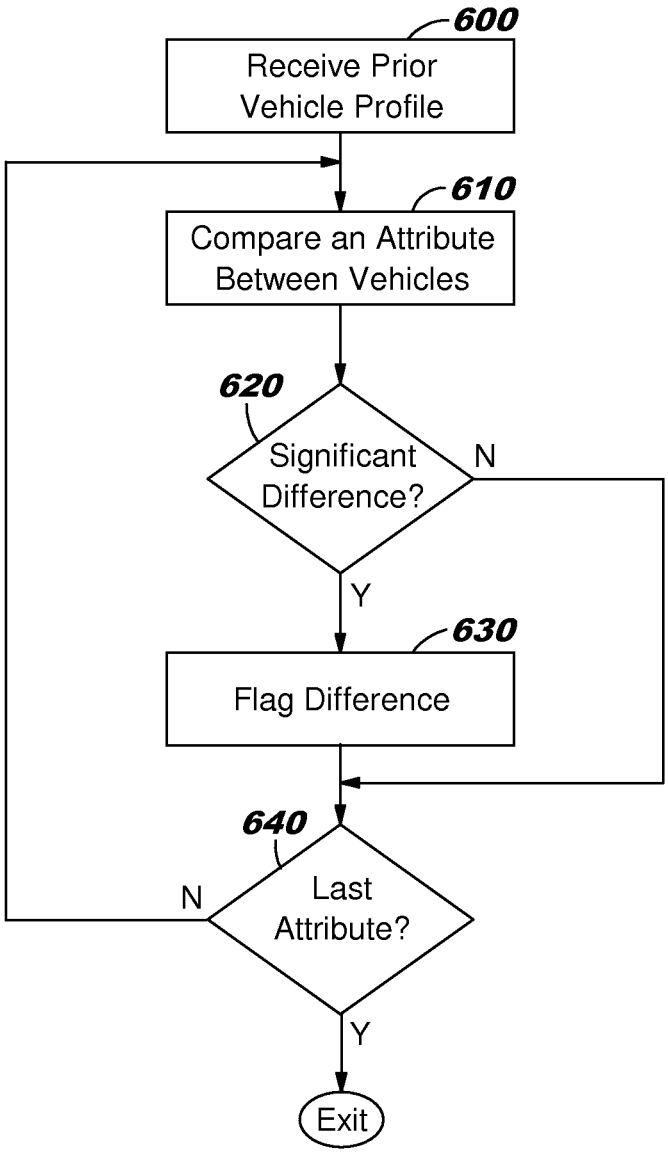
FIG. 6 is a flowchart showing a comparison of a current vehicle profile with a prior vehicle profile in which various embodiments may be implemented.

FIG. 6 is a flowchart showing a comparison of a current vehicle profile with a prior vehicle profile in which various embodiments may be implemented. This may be performed upon the identification of a driver and the importation of that driver's profile and that driver's prior vehicle profile to a current vehicle such as in blocks 362, 420 and 480 and step 505 described above.

In a first step 600, the profile of a prior vehicle is received. This may be from a mobile device, a server, or even directly between vehicles through a variety of communication technologies. In a second step 610, an attribute of the current vehicle profile is compared to an attribute of the prior vehicle. In a third step 620, it is determined whether the attribute is significantly different between vehicles. For example, if the driver is moving from a sports car to a sedan, the side g force capabilities of the prior vehicle for avoiding an object may be 30% greater. In such a case, the driver may not fully appreciate the difference and may come closer to an object in its path than judicious.

If not a significant difference in step 620, then processing proceeds to step 640. If a significant difference, then in step 630 the attribute of the prior vehicle is flagged. This attribute may then be taken into consideration by the warning system when determining when to act based on a condition. In an alternative embodiment, the difference between attributes may be provided to the warning system in a separate table for use while the driver is driving the current vehicle. Processing then proceeds to step 640.

In step 640, it is determined whether the last attribute of the vehicle profiles has been compared. If yes, then processing exits. If not, then processing returns to step 610 above. Alternative embodiments may be utilized to take advantage of a prior vehicle profile to enhance the operation of a warning system for the current vehicle.

The invention can take the form of an entirely software embodiment, or an embodiment containing both hardware and software elements. In a preferred embodiment, the invention is implemented in software or program code, which includes but is not limited to firmware, resident software, and microcode.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM), or Flash memory, an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing. Further, a computer storage medium may contain or store a computer-readable program code such that when the computer-readable program code is executed on a computer, the execution of this computer-readable program code causes the computer to transmit another computer-readable program code over a communications link. This communications link may use a medium that is, for example without limitation, physical or wireless.

A data processing system suitable for storing and/or executing program code will include at least one processor coupled directly or indirectly to memory elements through a system bus. The memory elements can include local memory employed during actual execution of the program code, bulk storage media, and cache memories, which provide temporary storage of at least some program code in order to reduce the number of times code must be retrieved from bulk storage media during execution.

A data processing system may act as a server data processing system or a client data processing system. Server and client data processing systems may include data storage media that are computer usable, such as being computer readable. A data storage medium associated with a server data processing system may contain computer usable code such as for developing, managing and porting a driver profile between multiple vehicles. A client data processing system may download that computer usable code, such as for storing on a data storage medium associated with the client data processing system, or for using in the client data processing system. The server data processing system may similarly upload computer usable code from the client data processing system such as a content source. The computer usable code resulting from a computer usable program product embodiment of the illustrative embodiments may be uploaded or downloaded using server and client data processing systems in this manner.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to explain the principles of the invention, the practical application, and to enable others of ordinary skill in the art to understand the invention for various embodiments with various modifications as are suited to the particular use contemplated.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method for porting driver profiles between vehicles comprising:

initiating a first communication session between a computer in the first vehicle and an external device;

storing a first vehicle profile based on attributes of the first vehicle;

receiving a driver profile from the first vehicle in the external device, wherein the driver profile includes driver behavior with vehicle controls that was used to configure warnings and other driver settings in the first vehicle;

initiating a second communication session between the external device and a computer in a second vehicle;

storing a second vehicle profile based on attributes of the second vehicle;

transferring the driver profile from the external device to a second memory in the second vehicle; and using the differences between the first vehicle profile and the second vehicle profile in combination with the driver profile to configure warning and other driver settings in the second vehicle.

2. The method of claim 1 wherein the external device is a mobile device with a memory for storing the driver profile.

3. The method of claim 1 wherein the external device is a server with a memory for storing the driver profile and wherein the first and second communication sessions are wireless.

4. The method of claim 1 wherein the external device is a communications device within the second vehicle for receiving the driver profile from the first vehicle and for transferring the driver profile to the computer in the second vehicle.

5. The method of claim 1 further comprising:

learning a driver's behavior with vehicle controls in the first vehicle; and using the learned behavior to produce the driver profile.

6. The method of claim 5 further comprising identifying the driver with identification criteria so that only identified driver behavior is used to produce the driver profile, wherein the identification criteria comprises one or more of the group of password, PIN code, biometrics, voice recognition, and RFID signal.

7. The method of claim 6 wherein the first vehicle uses a first driver profile for a first driver and a second driver profile for a second driver.

8. The method of claim 5 wherein the driver profile is periodically modified according to recent learned behavior.

9. The method of claim 7 wherein the driver profile is periodically modified according to recent learned behavior.

10. A computer usable program product comprising a computer usable storage medium including computer usable code for use in porting driver preferences between vehicles, the computer usable program product comprising code for performing the steps of:

initiating a first communication session between a computer in the first vehicle and an external device;

storing a first vehicle profile based on attributes of the first vehicle;

receiving a driver profile from the first vehicle in the external device, wherein the driver profile includes driver behavior with vehicle controls that was used to configure warnings and other driver setting in the first vehicle;

initiating a second communication session between the external device and a computer in a second vehicle;

storing a second vehicle profile based on attributes of the second vehicle;

transferring the driver profile from the external device to a second memory in the second vehicle; and using the differences between the first vehicle profile and the second vehicle profile in combination with the driver profile to configure warning and other driver settings in the second vehicle.

11. The computer usable program product of claim 10 further comprising:

learning a driver's behavior with vehicle controls in the first vehicle; and using the learned behavior to produce the driver profile.

12. The computer usable program product of claim 11 further comprising identifying the driver with identification criteria so that only identified driver behavior is used to produce the driver profile, wherein the identification criteria comprises one or more of the group of password, PIN code, biometrics, voice recognition, and RFID signal.

13. The computer usable program product of claim 12 wherein the first vehicle uses a first driver profile for a first driver and a second driver profile for a second driver.

14. The computer usable program product of claim 11 wherein the driver profile is periodically modified according to recent learned behavior.

15. A data processing system for porting driver preferences between vehicles, the data processing system comprising:

a processor; and a memory storing program instructions which when executed by the processor execute the steps of:

initiating a first communication session between a computer in the first vehicle and an external device;

storing a first vehicle profile based on attributes of the first vehicle;

receiving a driver profile from the first vehicle in the external device wherein the driver profile includes driver behavior with vehicle controls that was used to configure warnings and other driver settings in the first vehicle;

initiating a second communication session between the external device and a computer in a second vehicle;

storing a second vehicle profile based on attributes of the second vehicle;

transferring the driver profile from the external device to a second memory in the second vehicle; and using the differences between the first vehicle profile and the second vehicle profile in combination with the driver profile to configure warning and other driver settings in the second vehicle.

16. The data processing system of claim 15 further comprising the steps of:

learning a driver's behavior with vehicle controls in the first vehicle; and using the learned behavior to produce the driver profile.

17. The data processing system of claim 16 further comprising the step of identifying the driver with identification criteria so that only identified driver behavior is used to produce the driver profile, wherein the identification criteria comprises one or more of the group of password, PIN code, biometrics, voice recognition, and RFID signal.

* * * * *